US009032903B2

(12) United States Patent
Keller

(10) Patent No.: US 9,032,903 B2
(45) Date of Patent: May 19, 2015

(54) DEVICE FOR COATING SUBSTRATES BY MEANS OF HIGH-VELOCITY FLAME SPRAYING

(75) Inventor: Silvano Keller, Böttstein (CH)

(73) Assignee: AMT AG, Dottingen (CH)

( * ) Notice: Subject to any disclaimer, the term of this patent is extended or adjusted under 35 U.S.C. 154(b) by 387 days.

(21) Appl. No.: 13/093,901

(22) Filed: Apr. 26, 2011

(65) Prior Publication Data

US 2011/0265715 A1 Nov. 3, 2011

(30) Foreign Application Priority Data

Apr. 29, 2010 (CH) ..... 0643/10

(51) Int. Cl.

| | |
|---|---|
| ***B05B 1/24*** | (2006.01) |
| ***B05B 7/16*** | (2006.01) |
| ***B05B 7/20*** | (2006.01) |
| ***C23C 16/00*** | (2006.01) |
| ***C23C 4/12*** | (2006.01) |
| ***B05D 1/08*** | (2006.01) |

(52) U.S. Cl.

CPC . *C23C 4/124* (2013.01); *B05B 7/20* (2013.01); *B05B 7/208* (2013.01); *B05B 7/205* (2013.01)

(58) Field of Classification Search

USPC ..... 118/600, 300, 302, 308, 312; 239/79, 239/85, 132, 135

See application file for complete search history.

(56) References Cited

U.S. PATENT DOCUMENTS

| | | | | |
|---|---|---|---|---|
| 3,378,203 | A | 4/1968 | Stanton | |
| 4,375,954 | A | 3/1983 | Trudel | |
| 4,622,007 | A * | 11/1986 | Gitman | 239/423 |
| 5,535,953 | A * | 7/1996 | Huhne et al. | 239/419.3 |
| 5,834,066 | A * | 11/1998 | Kunzli et al. | 239/79 |
| 2008/0280056 | A1 * | 11/2008 | Maric et al. | 118/47 |

FOREIGN PATENT DOCUMENTS

| | | | |
|---|---|---|---|
| DE | 4429142 | A1 | 2/1996 |
| EP | 0458018 | A2 | 11/1991 |
| EP | 0848998 | A2 | 6/1998 |
| WO | WO 2004045777 | A1 * | 6/2004 |

* cited by examiner

*Primary Examiner* — Dah-Wei D Yuan
*Assistant Examiner* — Binu Thomas
(74) *Attorney, Agent, or Firm* — Maginot, Moore & Beck, LLP

(57) ABSTRACT

Proposed is a device for coating substrates by means of high-velocity flame spraying. The device comprises a combustion chamber (4), a first fuel feeder (L1) for feeding a liquid or gaseous fuel as well as at least one gas feeder for feeding an oxidative gas. The devise comprises furthermore a second fuel feeder (L5) for feeding a liquid or gaseous fuel as well as at least one further gas feeder for feeding a gas. Both the first gas feeder and the two fuel feeders (L1, L5) port into a common combustion chamber (4). In addition, means 24, 28 are provided for independent control of the fuel feed into the two fuel feeders (L1, L5).

5 Claims, 3 Drawing Sheets

DEVICE FOR COATING SUBSTRATES BY MEANS OF HIGH-VELOCITY FLAME SPRAYING

BACKGROUND

The invention relates to a device for coating substrates by means of high-velocity flame spraying.

Devices of this kind as discussed are known in a wealth of different embodiments and are employed for a wide variety of different purposes. For instance, they are employed to surface coat a great variety of substrates to render them resistant to temperature and/or wear and/or attrition and/or chemical attack.

Known from prior art are devices fueled by gas and also devices fueled by a liquid fuel, generic devices usually featuring at least one connection for the fuel and another connection for an oxidative gas. It is especially devices that are fueled liquid that may feature a further connection for compressed air. However, all of these known devices suffer from the drawback that their scope of application is limited.

Described in German patent DE 44 29 142 A1 is a head for high-velocity flame spraying powderized materials. This flame spraying head can be simultaneously fueled with two fuels (diesel/fuel oil and a fuel gas), the main fuel being diesel or fuel oil having a carbonizing content exceeding 0.5% by weight. To achieve as clean a combustion of the main fuel as possible permitting preevaporation of the fuel-oil and thus non-carbonizing combustion an evaporating flame is generated upstream of the actual main flame in the direction of flow of the gases. Thus, to achieve clean combustion of the main fuel free of residue both fuels always need to be fed simultaneously.

European patent EP 0 458 018 A2 discloses a HVOF burner comprising a primary combustion chamber and a secondary combustion chamber, both of which are fueled with separate fuels. The primary combustion chamber serves to melt the spray material which is then supersonically accelerated in the subsequent secondary combustion chamber so that it is gunned ultimately from the burner with high kinetic energy. Thus this burner too, always requires both gases to be fueled simultaneously.

In conclusion, U.S. Pat. No. 4,375,954 A discloses a burner fueled with a combination of gas and oil. This burner features a ring-shaped preheat chamber in which the oil is first heated by means of a combustion gas, after which the heated oil is jetted by a central nozzle into the combustion chamber for combustion. But, the burner involved in this case is not devised for surface coating substrates, it being simply a conventional burner.

SUMMARY

One object of the invention is to provide a device for coating substrates using high-velocity flame spraying so that it finds universal application by being operable in various operating modes.

In one preferred embodiment it is proposed that the outlet orifices of the further fuel feeder are arranged on a circle coaxial to the at least one outlet orifice porting centrally into the combustion chamber. Such an embodiment now always makes it possible, i.e. when fueled with the one or other fuel as well as with both fuels, to generate an homogenous and central combustion flame.

In another preferred embodiment of the device it is proposed that the outlet orifices of the at least one gas feeder are arranged on a circle coaxial to the outlet orifice porting centrally into the combustion chamber. This configuration promotes, on the one hand, an homogenous combustion flame and, on the other, combustion free of residues.

In still another preferred embodiment the device comprises a nozzle body adjoining the combustion chamber replaceably inserted in a connecting body of the device, the nozzle body featuring outlet orifices and the two fuel feeders and the first gas feeder being connected to the nozzle body such that the media necessary for operating the device can be fed to the combustion chamber via the cited outlet orifices of the nozzle body. The advantage of this configuration is that the nozzle body is replaceable so that simultaneously all of the outlet orifices are replaced new. This is particularly important because each body is exposed to very high stress in the region of the cited outlet orifices involving high wear and resulting in depletion of material and accumulation of material in the region of the outlet orifices, all of which is, of course, a nuisance detrimenting burner performance.

DESCRIPTION OF THE FIGURES

The invention will now be detailed by way of a preferred example embodiment with reference to the drawings in which.

DETAILED DESCRIPTION

Figure 1:
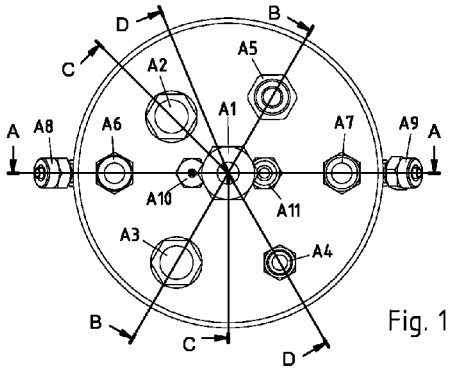
FIG. 1 is a view from the rear of the device for coating substrates by means of high-velocity flame spraying.

Referring now to FIG. 1 there is illustrated a device for coating substrates by means of high-velocity flame spraying in a view from the rear. The device comprises substantially the actual burner as well as means for feeding the coating material to be melted and coated. It is evident from the illustration as shown in FIG. 1 that the rear of the device has a plurality of connectors for feeding the media needed to operate the burner as well as for connecting a pressure sensor and another for connecting an igniter. It is understood that the number and arrangement of the connectors can vary. In the present example the connectors A1 to A9 are provided for feeding the media, i.e. A1 liquid fuel, A2 oxygen, A3 oxygen optional, A4 nitrogen, A5 gaseous fuel, A6 cooling water IN, A7 cooling water OUT, A8 powder, A9 powder. It is of course understood that instead of the media as cited above also other liquid or gaseous media may be fed via the connectors A1 to A7. The connector A10 is provided for the igniter and connector A11 for the cited pressure sensor.

Figure 2:
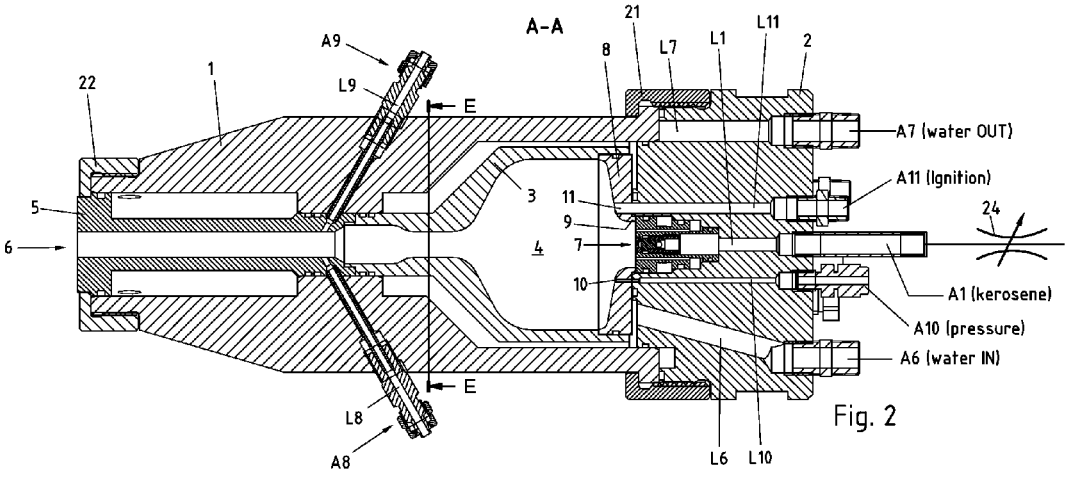
FIG. 2 is a section through the device taken along the line A-A in FIG. 1.

Referring now to FIG. 2 there is illustrated a simplified illustration of the device in a longitudinal section taken along the line A-A in FIG. 1. Since the basic configuration and operation of generic devices are known, not all of its elements are detailed in the following. Such devices are known professionally as high velocity oxygen fuel (HVOF) burners or guns.

The device comprises a base body 1, the rear of which features a connector body 2. Arranged within the base body 1 is a hollow body 3 forming internally the actual combustion chamber 4. The tubular outlet of the hollow body 3 is connected to a tubular nozzle 5 ending in the outlet 6 of the device. Inserted centrally in the connector body 2 in the side facing the combustion chamber 4 is a nozzle body 7. The nozzle body 7 is mounted replaceable in the connector body 2, it being axially located by means of a ring body 8. For this purpose the ring body 8 is provided with a ring-shaped protuberance 9 axially contacting the nozzle body 7. In turn the ring body 8 is in axial contact with one shoulder of the hollow body 3. The ring body 8 is provided with two axial feedthrough bores 10, 11, each of which ports a corresponding feeder L10, L11 machined in the connector body 2.

To secure the connector body 2 to the base body 1 and to axially position and locate further elements such as the nozzle body 7 and the ring body 8 a screwcap 21 is arranged at the base body 1, the female thread of which is designed to engage a male thread of the connector body 2 and to draw the connector body 2 axially against the base body 1 when tightened. A further screwcap 22 is arranged at the free end of the base body 1 by means of which the tubular nozzle 5 is urged towards the hollow body 3 and ring body 8 in the direction of the connector body 2. In any case, because two screwcaps 21, 22 are provided as shown, the device is quickly and simply assembled and disassembled. This is particularly an advantage since any parts subject to wear and tear, for example the hollow body 3, tubular nozzle 5 or nozzle body 7 can be quickly and simply replaced new. Thus, simply by releasing the screwcap 21 the connector body 2 can be separated from the base body 1 for removal of the nozzle body 7 as may be necessary for replacement.

As evident, a feeder leads from each connector into the interior of the connector body 2. From the fuel connector A1 a fuel feeder L1 leads centrally through the connector body 2 to the nozzle body 7, the latter serving to feed the media into the combustion chamber 4 necessary for operating the burner. The nozzle body 7 will now be described in more detail by way of the FIGS. 6*a*-6*c*. For controlling the fuel feed in the fuel feeder L1 a flow controller 24 is provided, as depicted diagrammatically, permitting, on the one hand, to adjust the fuel flow fed to the combustion chamber 4 per unit of time, and, on the other, serving also to open and close the corresponding fuel feeder L1.

No details are given as to the feeders L6, L7 connected to the corresponding cooling water connectors A6, A7 since such cooling water feeders serving to cool the components subjected to high thermal stress are known. The connector A10 is connected to the combustion chamber by an axial feeder L10. The connector A10 serves to connect a pressure sensor (not shown) by means of which the pressure prevailing in the combustion chamber 4 can be measured. Leading likewise from the connector A11 is a feeder L11 axially through the connector body 2 into the combustion chamber 4. This feeder L11 serves to include an igniter (not shown) for igniting the fuel mixture in the combustion chamber 4. From each of the two powder connectors A8, A9 a feeder L8, L9 leads at an angle into the device. The two powder feeders L8, L9 port substantially radially into the tubular nozzle 5 relative to the longitudinal centerline of the device. The powder feeders L8, L9 serve to feed the coating powder which on entering the tubular nozzle 5 is entrained by the hot gas flow and rendered molten at least in part by the prevailing temperature. It is understood that instead of feeding the coating material powdered it could also be fed in the form of a wire, for example.

Figure 3:
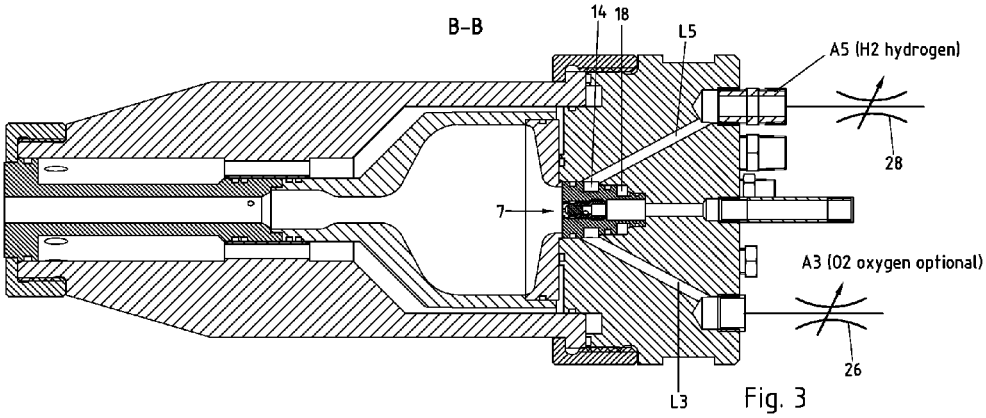
FIG. 3 is a section through the device taken along the line B-B in FIG. 1.

Referring now to FIG. 3 there is illustrated the device in a longitudinal section through the device taken along the line B-B in FIG. 1 making it particularly clear how from the connector A5 a feeder L5 is guided at an angle through the connector body 2 to a first (front) annular duct 14 of the nozzle body 7. Leading from the connector A3 is a further feeder L3 passing through the connector body 2 at an angle to the first annular duct 14 of the nozzle body 7. Whilst the feeder L3 serves to optionally feed an oxidative gas, such as oxygen for instance, via the feeder L5 a second fuel, preferably a fuel gas can be fed to the combustion chamber 4. In any case, both fuel feeders port into the common combustion chamber 4.

For control of the fuel feed via the feeder L5 a flow controller 28 is provided serving both to open and close the corresponding fuel feeder L5 and to adjust the fuel flow per unit of time. For controlling the feed of oxidative gas in the feeder L3 a controller 26 is provided which, where necessary, may be sufficient to be designed as an ON/OFF switch for feeding the oxidative gas. Feeding an oxidative gas via the feeder L3 is usually only done when the burner is operated with a fuel, namely when a first fuel, preferably kerosene, is fed centrally via the feeder L1.

Figure 4:
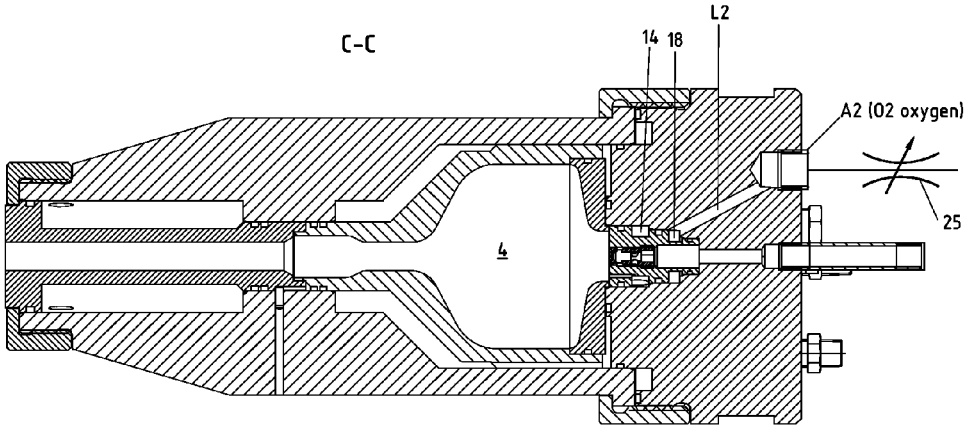
FIG. 4 is a section through the device taken along the line C-C in FIG. 1.

Referring now to FIG. 4 there is illustrated the device in a longitudinal section through the device taken along the line C-C in FIG. 1 showing how a feeder L2 leads from the connector A2 to a second (rear) annular duct 18 of the nozzle body 7. The feeder L2 serves to feed an oxidative gas, preferably oxygen, into the combustion chamber, so that, in addition to the two fuel feeders also the feeder L2 for feeding an oxidative gas ports into the common combustion chamber 4. For control of the gas feed a flow controller 25 is provided.

Figure 5:
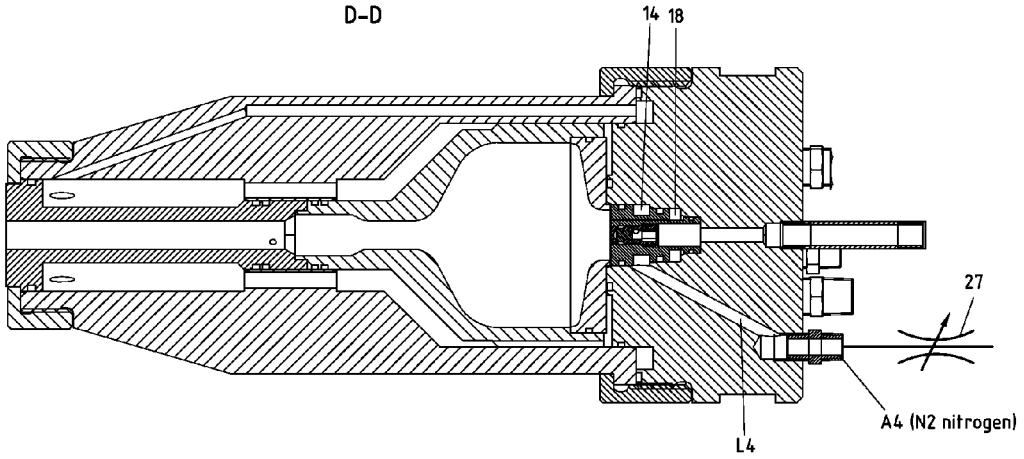
FIG. 5 is a section through the device taken along the line D-D in FIG. 1.

Referring now to FIG. 5 there is illustrated the device in a longitudinal section through the device taken along the line D-D in FIG. 1 making it evident how the connector A4 is connected via a feeder at an angle to the front annular duct 14 of the nozzle body 7. The feeder L4 preferably serves to feed an inert gas, particularly nitrogen as controlled by a flow controller 27.

Thus, in summary, it is to be established that the connectors A3, A4 and A5 are connected to the annular duct 14 of the nozzle body 7 by the three feeders L3, L4, L5 whilst the connector A2 leads via the feeder L2 to the second annular duct 18. Where a medium is fed via at least two of the three feeders L3, L4, L5 connected to the front annular duct 14, these media are mixed in the annular duct 14.

Figure 6A:
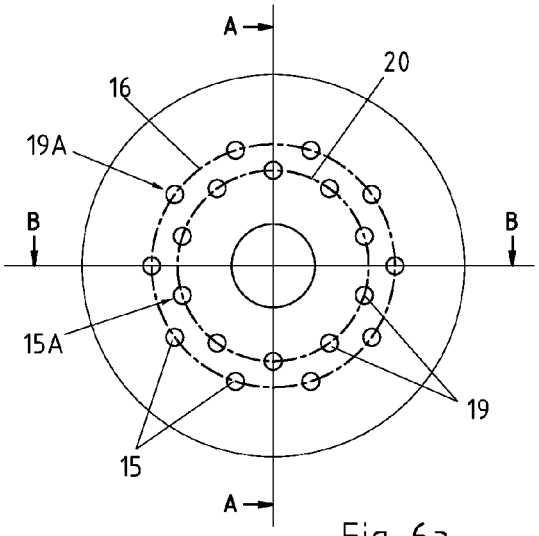
FIG. 6*a* is a view from the front of a nozzle body.
Figure 6B:
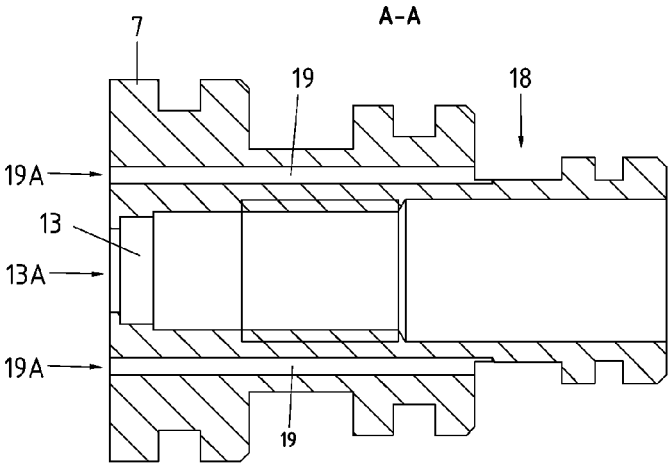
FIG. 6*b* is a section through the nozzle body taken along the line A-A in FIG. 6*a;*
Figure 6C:
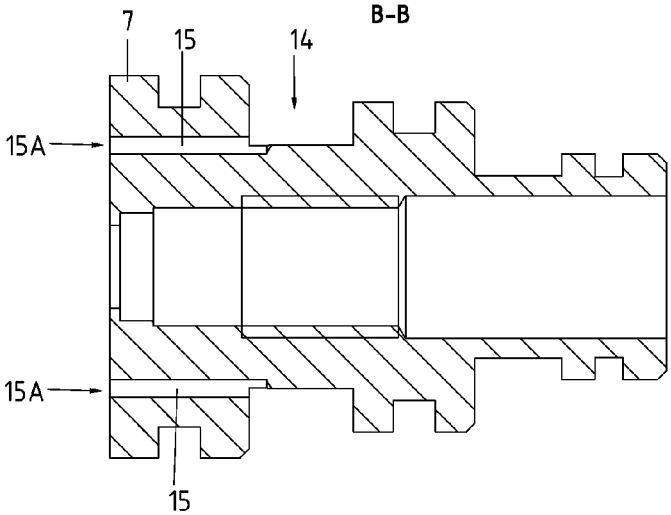
FIG. 6*c* is a section through the nozzle body taken along the line B-B in FIG. 6*a*.

FIGS. 6*a*, 6*b* and 6*c* serve to explain the configuration of the nozzle body 7 in more detail. Referring now to FIG. 6*a* there is illustrated the nozzle body 7 in a view as seen from the combustion chamber side whilst FIG. 6*b* is a longitudinal section through the nozzle body taken along the line A-A in FIG. 6*a* and FIG. 6*c* is a longitudinal section through the nozzle body taken along the line B-B in FIG. 6*a*.

It is evident from FIG. 6*b* how the axial bores 19 lead from the second (rear) annular duct 18 to the front face of the nozzle body 7. These bores 19 form towards the side of the combustion chamber a first group of outlet orifices 19A via which a medium (or media) can be fed to the combustion chamber.

Referring now to FIG. 6*c* it is evident how further axial bores 15 lead from the front annular duct 14 to the front face of the nozzle body 7, they forming towards the side of the combustion chamber a second group of outlet orifices 15A.

Referring again to FIG. 6*a* it is evident that the bores 19 of the group connecting the second (rear) annular duct 18 are evenly distributed on an inner circle 20 whilst the bores 15 of the group connecting the first (front) annular duct 14 are evenly distributed on an outer circle 16. Both circles 16, 20 are arranged coaxial to a central outlet orifice 13 of the nozzle body 7. The central outlet orifice 13 of the nozzle body 7 serves to mount an injector nozzle or valve (not shown) for injecting the liquid fuel into the combustion chamber. For this purpose the nozzle body 7 is provided with a female thread serving to secure one such injector. Since such injectors are known, they are not detailed in the following.

The basic advantages of such a device involve it being universal in application. Thus, the burner can be fueled, for example, with two fuels simultaneously by a first fuel, for example kerosene, being fed to the combustion chamber 4 via the nozzle body 7—injector—centrally whilst simultaneously a further fuel, for example hydrogen, is fed to the combustion chamber 4, for instance, via the bores 15, 19 of the outer or inner circle of bores of the nozzle body 7. In addition, any number of further media can be fed to the combustion chamber via the two connectors A3, A4 correspondingly as required. Thus, an oxidative gas such as oxygen for instance can be fed via the connector A2 and/or A3. Where the oxygen is fed via the connector A3 it mixes in the front annular duct 14 with the medium fed via the connector A4 and/or A5. For example, an inert gas such as, for example, nitrogen may be fed via the connector A4, resulting in a drop in temperature in the combustion chamber, termed a cold gas feed professionally. Arranging the bores 15, 19 or outlet orifices 15A, 19A in a circle has the advantage that the various media can be simultaneously fed to the combustion chamber centrally, thus rendering the device particularly suitable for melting coarse powders and for applying thick coatings and generating rough surfaces since feeding the burner with two fuels per unit of time enables very high temperatures and/or high melting rates of the coating powder and/or very high gas velocities to be attained.

Although it is, of course, understood that the burner can also be fed just a single fuel, a continuous or discontinuous transition from one fuel to the other is also possible since a separate flow controller can be provided in each of the two fuel feeders. Such a device now makes it possible, for example, to apply a basic coating with the one fuel, preferably kerosene, topped by a further coating by feeding another fuel or both fuels. This formerly necessitated the use of two such different devices.

Depending on the mode of operation it may prove advantageous to stream a gaseous medium into the combustion chamber via the bores 15, 19 of the inner and/or outer bore circle of the nozzle body 7 to prevent debris accumulating in the bores 15, 19 and/or entry of combustion chamber gases thereinto.

Depending on the wanted mode of operation the nozzle body 7 serves to feed one or two fuels or fuel mixtures as well as one or more oxidative gases as well as any further gases as may be required.

It is understood, of course, that the burner may also be operated with just a single fuel, both liquid and gaseous fuels always being possible, for instance kerosene as a liquid fuel whilst hydrogen, natural gas, propylene, propane or ethylene may be employed. It is understood that the modes as aforementioned are not at all to be considered as being conclusive. Instead, a great many different operating modes are possible with the device as described herein and, of course, the number and arrangement of the connectors and feeders described may vary.

Another advantage afforded by the device or burner configured in accordance with the invention is that a smooth change can be made from one fuel to another without having to halt operation.

However, the configuration of the actual burner may also vary, of course. For instance, instead of, or in addition to, the bores 15, 19 arranged in a circle the nozzle body 7 may be provided with an annular duct or a ring of sections via which one or more media can be fed to the combustion chamber 4.

The invention claimed is:

1. A device for coating substrates by means of high-velocity flame spraying comprising:

a base body having an inlet end and an outlet end and an open-ended axial passage that extends between the inlet end and the outlet end;

a hollow body defining a combustion chamber and replaceably inserted in and enclosed within the inlet end of the base body of the device;

a tubular nozzle replaceably inserted in the outlet end of the base body downstream of the hollow body in the direction of flow of the gases, the tubular nozzle provided with powder feed ports oriented substantially radially or at an angle to a longitudinal centerline passing through the tubular nozzle;

a connector body attached to the inlet end of the base body and including an inner side facing the combustion chamber and an outer side facing away from the combustion chamber, the inner side defining a mounting recess;

a nozzle body replaceably mounted in the mounting recess of the connector body, the nozzle body including inlet orifices for receiving fluid via the connector body and outlet orifices for discharging fluid into the combustion chamber;

a ring body that is interposed between the connector body and the hollow body, the ring body being configured to contact the nozzle body within the mounting recess and to be held in contact with the nozzle body by the hollow body to retain the nozzle body within the mounting recess;

a first fuel feeder in the connector body for feeding a first liquid or gaseous fuel to a first inlet orifice of the nozzle body;

a first gas feeder in the connector body for feeding an oxidative gas to a second inlet orifice of the nozzle body;

at least one additional fuel feeder in the connector body for respectively feeding an additional liquid or gaseous fuel to a third inlet orifice of the nozzle body, and at least one additional gas feeder for feeding for feeding an oxidative or inert gas to the third inlet orifice of the nozzle body;

a first screw cap threadingly attached to the outlet end of the base body, the first screw cap holding the tubular nozzle body in the inlet end of the base body and urging the tubular nozzle body toward and into engagement with the hollow body which causes the hollow body to press the ring body toward the nozzle body; and a second screw cap on the inlet end of the base body and that threadingly attaches the inlet end of the base body to the connector body, wherein the third inlet orifice comprises a first annular duct recessed in a circumference of the nozzle body, wherein the nozzle body includes first axial bores that fluidly connect the first annular duct to a first plurality of the outlet orifices, and wherein the first fuel feeder and the at least one additional fuel feeder are each provided with a separate flow controller configured to control the flow rate of the fuel supplied to the respective fuel feeders independent of each other.

2. The device as set forth in claim 1, characterized in that the nozzle body includes a central outlet orifice that is fluidly connected to the first inlet orifice.

3. The device as set forth in claim 2, characterized in that the first plurality of the outlet orifices are arranged on a first circle around the central outlet orifice.

4. The device as set forth in claim 3, characterized in that the second inlet orifice comprises a second annular duct recessed in a circumference of the nozzle body at a position spaced apart from the first annular duct and the nozzle body includes second axial bores that fluidly connect the second annular duct to a second plurality of the outlet orifices.

5. The device as set forth in claim 4, characterized in that the second plurality of the outlet orifices are arranged on a second circle, said second circle surrounding and being concentric with the first circle.

* * * * *